US006053850A

United States Patent [19]

Martinez et al.

[11] Patent Number: 6,053,850

[45] Date of Patent: Apr. 25, 2000

[54] VARIABLE RESISTANCE EXERCISE DEVICE

[76] Inventors: Lorenzo R. Martinez; Gilbert Lance Martinez, both of 5116 Chambliss Dr., Las Vegas, Nev. 89130

[21] Appl. No.: 09/204,139

[22] Filed: Dec. 2, 1998

[51] Int. Cl.[7] ..... A63B 21/12

[52] U.S. Cl. ..... 482/74; 482/119; 482/118; 482/40

[58] Field of Search ..... 482/39, 40, 74, 482/65, 69, 119, 118; 254/391; 226/195, 38

[56] References Cited

U.S. PATENT DOCUMENTS

| | | | |
|---|---|---|---|
| 3,143,309 | 8/1964 | Clarke | 226/195 |
| 3,519,269 | 7/1970 | Howlett et al. | 482/116 |
| 4,469,324 | 9/1984 | Dolan . | |
| 4,648,597 | 3/1987 | Adler | 482/57 |
| 5,137,272 | 8/1992 | Wilkinson . | |
| 5,167,601 | 12/1992 | Frappier . | |
| 5,197,931 | 3/1993 | Wroclawsky . | |
| 5,429,572 | 7/1995 | Brown et al. | 482/116 |
| 5,472,394 | 12/1995 | Michaelson . | |
| 5,509,873 | 4/1996 | Corn . | |
| 5,820,519 | 10/1998 | Slenker | 482/4 |

*Primary Examiner*—Jerome Donnelly
*Attorney, Agent, or Firm*—Kenneth L Tolar

[57] ABSTRACT

A variable resistance exercise assembly for runners, football players and the like includes a housing having a pair of opposing spaced side walls with an end wall therebetween. A fixed cylinder is rotatably mounted between the side walls. A cord is wrapped about the cylinder with each of its two ends extending from the end wall of the housing. Each end of the cord includes a hook for attaching either end of the cord to a shoulder harness. A tensioning roller is slidably mounted between the side walls which may be moved towards and away from the fixed cylinder with an adjustment means to apply a desired amount of resistance to the cord

7 Claims, 1 Drawing Sheet

VARIABLE RESISTANCE EXERCISE DEVICE

BACKGROUND OF THE INVENTION

The present invention relates to an exercise device including a cord which may be attached to an exerciser that applies a select amount of resistance to the leg muscles when the exerciser walks or runs.

DESCRIPTION OF THE PRIOR ART

Certain athletes, such as sprinters and football players, require isolated training of specific leg muscle groups. Although weight training and similar methods provide a form of resistance training for strengthening various leg muscles, such methods do not always adequately isolate or exert the same muscles that are exerted during competition. The present invention relates to a device which may be secured to a fixed object having a cord extending therefrom. The cord is extendable from the housing under a predetermined amount of resistance. Accordingly, an exerciser wearing a harness attached to the cord may walk or run against the resistance to engage in a strenuous, intense workout.

Various exercise devices exist in the prior art. For example, U.S. Pat. No. 5,509,873 issued to Corn relates to an exercise device attached to a belt that fits around the waist of a user. The device includes handles attached to retractable cords. The device provides adjustable resistance as the handles are extended away from the waist of the user.

U.S. Pat. No. 5,472,394 issued to Michaelson relates to a parachute for athletic resistance and speed training.

U.S. Pat. No. 5,197,931 issued to Wroclawsky relates to an exercise apparatus for working the arms and the legs simultaneously. The device includes a wheeled frame having elastic straps that engage the legs just above the knees and a pair of elastic straps that are grasped by the hands. The various straps are then worked in running and punching motions.

U.S. Pat. No. 5,167,601 issued to Frappier relates to a sprinter leg muscle training device and method including an elongated, elastomeric and stretchable tether having leg bindings secured to each end thereof. The tether further includes a position adjustable attachment means.

U.S. Pat. No. 5,137,272 issued to Wilkinson relates to an exercise device for resistance walking having a back foundation plate with a belt attached thereto. An extension pole extends down the back of the foundation plate to which a plurality of leg elastic resistance devices are removably attached.

U.S. Pat. No. 4,469,324 issued to Dolan relates to a motorized reel mounted at a fixed location having a rope mounted thereabout which may be attached to a runner. The device further includes a set of controls such as a throttle and brake for reeling in the runner at a controlled speed which is slightly faster than the runmner's ordinary pace.

Although various resistant adjustable exercise devices exist in the prior art, the resistance adjustment means are complicated and expensive to manufacture. Furthermore, they include a myriad of components and are difficult to transport and store. The present invention relates to a compact, lightweight housing which may be conveniently attached to a fixed object. A cord is wrapped around a fixed rotatable cylinder within the housing with each of its two ends extending from the housing. The housing also includes a movable tension roller which may be thrust against the fixed cylinder to exert a predetermined amount of resistance thereto. A shoulder harness is then attached to either end of the rope. Whenever an exerciser wearing the harness runs or walks, the selected resistance is applied to the leg muscles resulting in an intense, exercise interval.

SUMMARY OF THE INVENTION

The present invention relates to a variable resistance exercise device. The device comprises a substantially U-shaped housing having two opposing side walls and an end wall therebetween. Disposed between the side walls and rotatably mounted thereto is a fixed cylinder having a cord wrapped thereabout. Each end of the cord extends through an aperture on the end wall of the housing. A hook member is attached to each end of the cord for securing either end of the cord to a shoulder harness. A tension roller assembly is slidably mounted to the housing side walls and is movable towards and away from the fixed cylinder with an adjustment knob to apply a predetermined amount of force to the fixed cylinder. Accordingly, a user wearing the harness can walk or run to apply a desired amount of resistance to the leg muscles. It is therefore an object of the present invention to provide an exercise device specifically designed for runners and football players.

It is yet another object of the present invention to provide an exercise device in which the resistance provided may be selectively varied.

It is yet another object of the present invention to provide a compact exercise device which can be easily transported and stored. Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
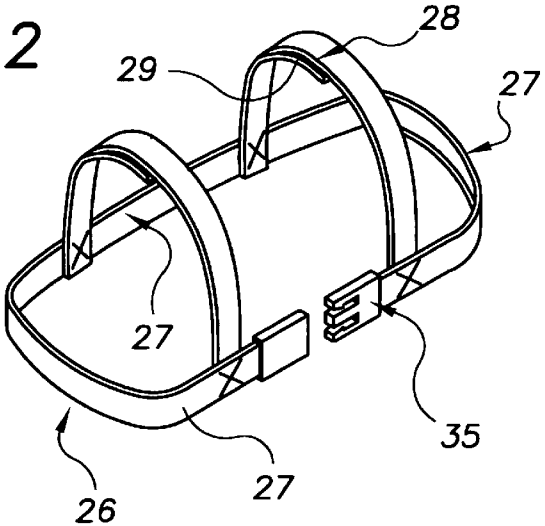
FIG. 2 depicts the shoulder harness according to the present invention.
Figure 1:
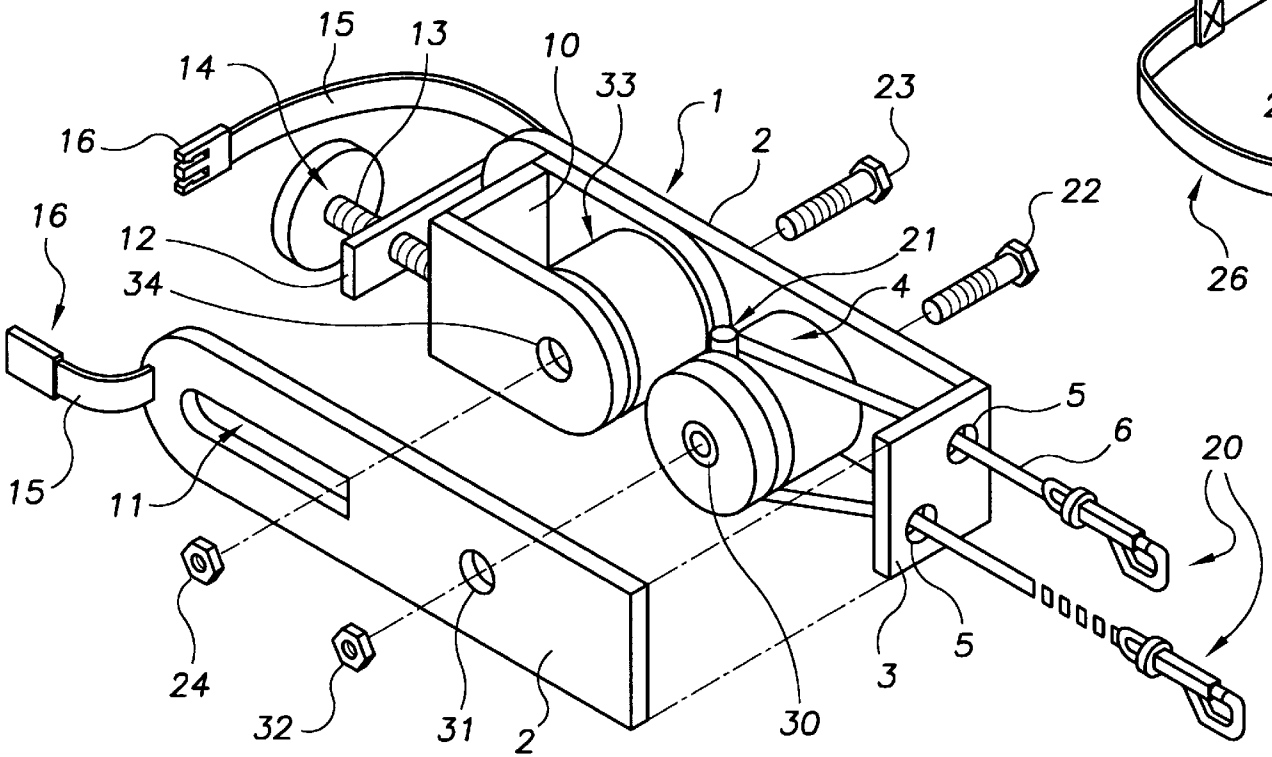
FIG. 1 depicts the inventive device with the housing partially exploded to depict the internal components.

Referring now to FIGS. 1 through 2, the present invention relates to a variable resistance exercise device. The device comprises a small, compact housing 1 formed of a pair of elongated planar side walls 2 with a planar end wall 3 therebetween. Disposed between the side walls and rotatably mounted thereto is a fixed cylinder 4 with a cord 6 wrapped thereabout. Each of two ends of the cord extend through an aperture 5 on the end wall, each end having a hook member 20 thereon. A pin 21 extends outwardly from the fixed cylinder for maintaining separation between ingoing and outgoing portions of the cord as they are wound and unwound from the cylinder. The cylinder further includes a central bore 30 for receiving a mounting bolt 22. The bolt is also received within aligned apertures 31 on the housing side walls and is secured to one of the sidewalls with a nut 32 to rotatably attach the cylinder to the housing. However, other conventional attachment means may also be used.

Slidably mounted between the opposing side walls is a tension roller assembly. The assembly includes a U-shaped bracket 10 having a roller 33 disposed therebetween. Each housing side wall includes an elongated slot 11 that receives a second bolt 23 inserted through a central bore 34 in the roller and a pair of opposing aligned apertures on the U-shaped bracket The bolt is secured with a nut 24 whereby the roller assembly may slide towards and away from the fixed cylinder. As with the fixed cylinder, the roller assembly may be secured between the housing side walls with any other conventional means.

An adjustment means is also provided to vary the position of the tension roller. The adjustment means includes a strip 12 having a threaded aperture therethrough. The strip is disposed between the two side walls, at an end opposite the end wall. Threadedly received within the threaded aperture is a shaft 13 having a knob 14 at an outboard end. The inboard end of the threaded shaft engages the U-shaped roller bracket whereby rotation of the knob in a predetermined direction will thrust the roller against the fixed cylinder. The roller may be tightened against the cylinder to impart a desired amount of rotational resistance to the cylinder.

A first end of each side wall includes a strap 15 having an attachment means 16 at an end allowing the straps to be joined about a fixed object. Preferably, the attachment means refers to a quick-connect buckle; however, other conventional attachment means may be used.

The hook on either end of the cord may be secured to a loop or ring (not pictured) on a shoulder harness 26. The shoulder harness includes a horizontal separable strap 27 for securing about the user's upper torso and a pair of vertical straps 28 extending therefrom that are placed across the top of a user's shoulders. The lower surface of each vertical strap preferably includes a padded portion 29. Each separable portion of the horizontal strap includes a buckle 35 thereon for removably securing the harness to a user's torso.

The above described device may be used as follows. The shoulder harness is secured to an end of the cord. A desired tension is selected by rotating the tension roller adjustment knob. A user may then either walk or run to apply the selected resistance to the user's legs. When the entire length of cord has been extended, the harness may be removed and reattached to the other end to repeat the exercise.

The above described device may be constructed with metal, plastic, rubber or any similar equivalent. However, as will be readily apparent to those skilled in the art, the size, shape and materials of construction may be varied without departing from the spirit of the present invention.

The above described device is not to be limited to the exact details of construction enumerated above. For example, although a shoulder harness has been depicted and described, any type of body attachable device may be used such as a waist strap, torso harness, etc. Furthermore, any suitable attachment means may be used to attach the housing to a fixed object.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An exercise device comprising:

a housing having a cylinder rotatably mounted therein;

a cord wrapped about said cylinder, said cord having two ends with each end extending from said housing;

a harness means attachable to either end of said cord and to a user's body;

a tensioning means, said tension means including a roller slidably mounted within said housing for applying a predetermined amount of rotational resistance to said cylinder to selectively vary the force required to unwind said cord from said cylinder;

an adjustment means for thrusting said roller against said cylinder.

2. A device according to claim 1 wherein said adjustment means comprises:

a threaded shaft threadedly received within an aperture on said housing, said shaft having an outboard end and an inboard end, the outboard end having a knob attached thereto with the inboard end normally engaging said roller whereby rotating said knob moves said roller towards and away from said cylinder.

3. A device according to claim 1 further comprising an attachment means for attaching said housing to a fixed object.

4. A device according to claim 1 wherein said cylinder further includes a pin extending outwardly therefrom for separating ingoing and outgoing portions of said cord.

5. A device according to claim 1 wherein said harness includes a pair of shoulder straps each including a padded lower surface.

6. An exercise device comprising:

a housing having a pair of opposing side walls and an end wall therebetween, said end wall having a pair of apertures;

a cylinder rotatably mounted between said side walls;

a cord wrapped about said cylinder, said cord having two ends with each end extending through an aperture on the housing end wall;

a tensioning roller slidably mounted between said side walls of said housing;

an adjustment means for moving said tensioning roller towards and away from said cylinder to apply a desired amount of rotational resistence thereto;

a harness means attachable to either end of said cord which may be strapped about a user.

7. A device according to claim 6 further comprising a strap at a first end of each housing side wall, each strap having a fastener means at a distal end thereof for joining the straps and securing the housing to a fixed object.

* * * * *